US006203600B1

(12) United States Patent
Loreth

(10) Patent No.: US 6,203,600 B1
(45) Date of Patent: Mar. 20, 2001

(54) DEVICE FOR AIR CLEANING

(75) Inventor: Andrzej Loreth, Åkersberga (SE)

(73) Assignee: Eurus Airtech AB (SE)

( * ) Notice: Subject to any disclaimer, the term of this patent is extended or adjusted under 35 U.S.C. 154(b) by 0 days.

(21) Appl. No.: 09/194,685

(22) PCT Filed: Jun. 3, 1997

(86) PCT No.: PCT/SE97/00956

§ 371 Date: Dec. 1, 1998

§ 102(e) Date: Dec. 1, 1998

(87) PCT Pub. No.: WO97/46322

PCT Pub. Date: Dec. 11, 1997

(30) Foreign Application Priority Data

Jun. 4, 1996 (SE) ..... 9602211

(51) Int. Cl.[7] ..... B03C 3/80

(52) U.S. Cl. ..... 96/40; 55/520; 55/DIG. 5; 96/50; 96/94; 96/98; 264/280; 264/DIG. 48

(58) Field of Search ..... 96/69, 95, 98, 96/50, 94, 39, 40; 95/59; 55/520, DIG. 5, 497, 498; 264/DIG. 48, 280

(56) References Cited

U.S. PATENT DOCUMENTS

| | | | | |
|---|---|---|---|---|
| 2,926,749 | | 3/1960 | Oswald | 55/141 X |
| 4,313,741 | | 2/1982 | Masuda et al. | 55/138 |
| 4,354,861 | * | 10/1982 | Kalt | 96/69 |
| 5,198,003 | | 3/1993 | Haynes | 264/DIG. 48 |
| 5,766,318 | * | 6/1998 | Loreth et al. | 96/69 |
| 5,980,614 | * | 11/1999 | Loreth et al. | 96/69 X |
| 5,993,521 | * | 11/1999 | Loreth et al. | 96/98 X |

FOREIGN PATENT DOCUMENTS

| | | | | |
|---|---|---|---|---|
| 2332418 | * | 5/1974 | (DE) | 96/98 |
| 6-31200 | * | 2/1994 | (JP) | 96/98 |
| WO93/16807 | | 9/1993 | (WO) . | |
| WO 95/14534 | | 6/1995 | (WO) . | |

* cited by examiner

*Primary Examiner*—Richard L. Chiesa
(74) *Attorney, Agent, or Firm*—Siemens Patent Services LC

(57) ABSTRACT

A precipitator having a through-flowing passage for the air to be purified. The precipitator is intended to be included in an air purification device, especially for purifying air from electrically charged particles. The precipitator is electrically connected to a high voltage source and has at least two electrode elements or groups of such elements arranged at different potential relative to each other. The electrode elements being designed as band-like strips that are arranged to circle at least once, and preferably several times, around an imaginary axis at a gap distance (d), seen in radial direction relative to the imaginary axis, from adjacent electrode elements. The extension of the electrode elements in the air flow direction is essentially less than their circled length around the imaginary axis. The edge section of the electrode elements, preferably at one side only of the body of the precipitator, are fixed relative to each other by the aid of fixing material.

16 Claims, 7 Drawing Sheets

DEVICE FOR AIR CLEANING

FIELD OF THE INVENTION

Figure 1:
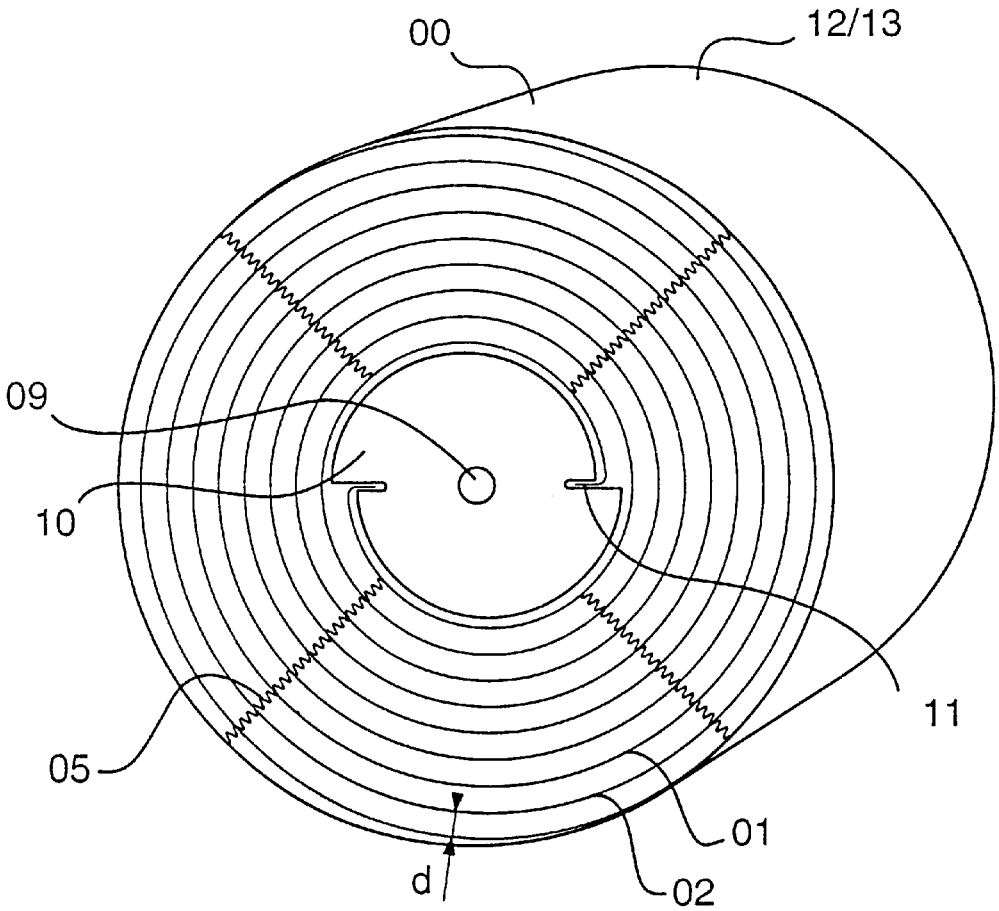

This is a national stage application of International Application No. PCT/SE97/00956, filed Jun. 3, 1997.

The present invention refers to a precipitator having a through-flowing passage for the air to be purified, said precipitator being intended to be included in an air purification device, especially for purifying air from electrically charged particles, said precipitator being electrically connected to a high voltage source and comprising at least two electrode elements or groups of such elements arranged at different potential relative to each other, said electrode elements being designed as band-like strips that are arranged to circle at least once, and preferably several times, around an imaginary axis at a gap distance, seen in radial direction relative to the imaginary axis, from adjacent electrode elements, that the extension of the electrode elements in the air flow direction is essentially less than their circled length around the imaginary axis. The invention also refers to a method for manufacturing a precipitator according to the present invention.

BACKGROUND OF THE INVENTION

In SE-B-469 466 a two step electro filter having an ionization section is described, said section being downstream followed by a so called precipitator. The electrode elements of the precipitator according to the mentioned patent application constitute of planar plates that comprise high resistant non-metallic material, said material also being designed as antistatic (so called dissipative material). By such a material an essential improvement of the separation ability is achieved compared to the traditional design, i.e. electrode elements of the precipitator comprising metallic material, and the voltage between the electrode elements can reach a higher level than in connection with traditional electrode elements manufactured from material having low resistivity. Further a new design for the ionization chamber is disclosed, said design being very simple and very efficient in terms of particle charging and with an exceptionally low emission of ozone.

In SE 9303894-1 is described a further development of the design of a precipitator according to the patent application mentioned above. By screening of the edge sections of the electrode elements of the precipitator possibilities are achieved, according to this patent application, to further increase the voltage between said elements and thus an increased separation ability.

In spite of an improved performance and new design of the electro filter cassette, inter alia from a cellulose based material and very simplified design of the ionization chamber, said inventions have not initiated an increased use of air purification devices and also not in other applications as for instance filters in ventilation ducts, coupe filters, filter for cooking fumes, a so called cooker hood, or in more industrial application areas, although the need of fresh air no longer might be questioned and although the electro filter technique in many aspects is much better than the traditional filter technique comprising so called barrier filters.

The reason for this very restricted use of the electro filter technique might be that systems for air purification also must fulfil other essential demands, apart from the air purification efficiency, to become accepted within wider circles of users.

These demands vary essentially depending on application area but they are also very different within the same application area for different users and different environments having different pollution load etc.

To exemplify certain demands that must be set up within at least one area of use, for instance separate air purifiers as a complement to existing ventilation, one can mention low initial cost/running charges per $m^3$ purified air, low noise level, flexible location possibilities and adaption to different interiors, a simple way to operate the set-up, low cost for replacement cassettes, the way to handle used filter cassetes adapted both to the environment but also to the status of the user, for instance a healthy person or a person allergic to dust/an asthmatic person, long life of the devices etc.

SUMMARY OF THE INVENTION

The invention primarily aims at a new design of precipitators having a wide area of use, inter alia as duct filters, separate air purifiers, cooker hoods/filters, coupé filters etc. but also the design of the casing and also the design of the surrounding equipment for the cleaning and service of the device, all in view of answering to the above mentioned demands.

Thus, it is of no importance in which way the charging of the aerosols take place before they are transported through the device. Charging of the aerosols may occur in so called ionization chambers arranged in the air flow passage upstream of the precipitator, seen in the air flow direction through the device, or charging may take place in the space where the device is located or in some other way.

BRIEF DESCRIPTION OF THE INVENTION

Figure 2:
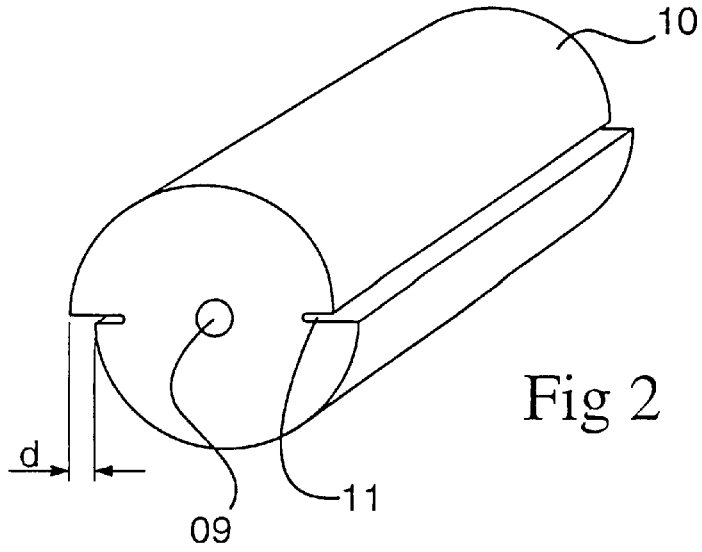
Figure 3:
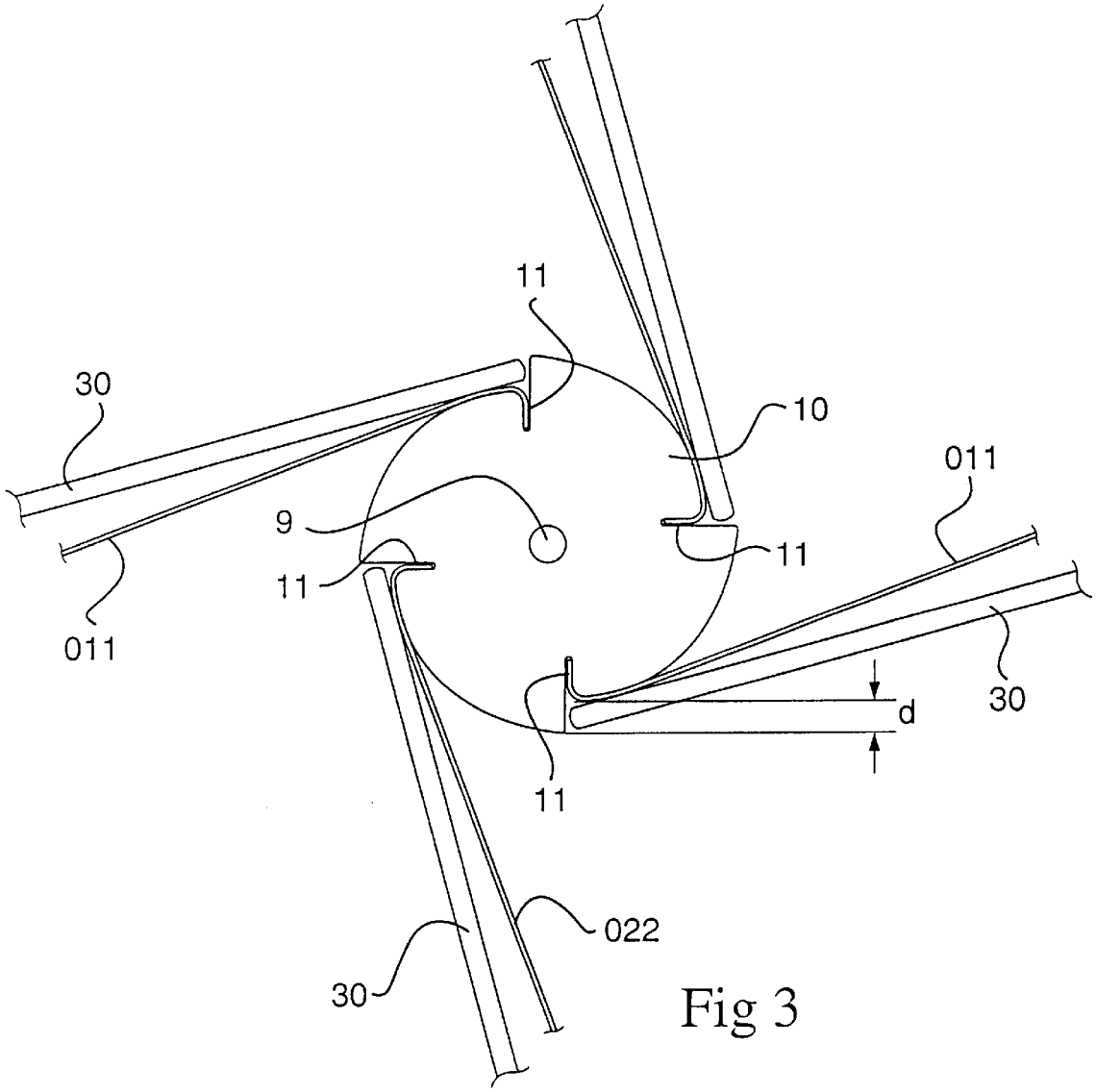
Figure 4:
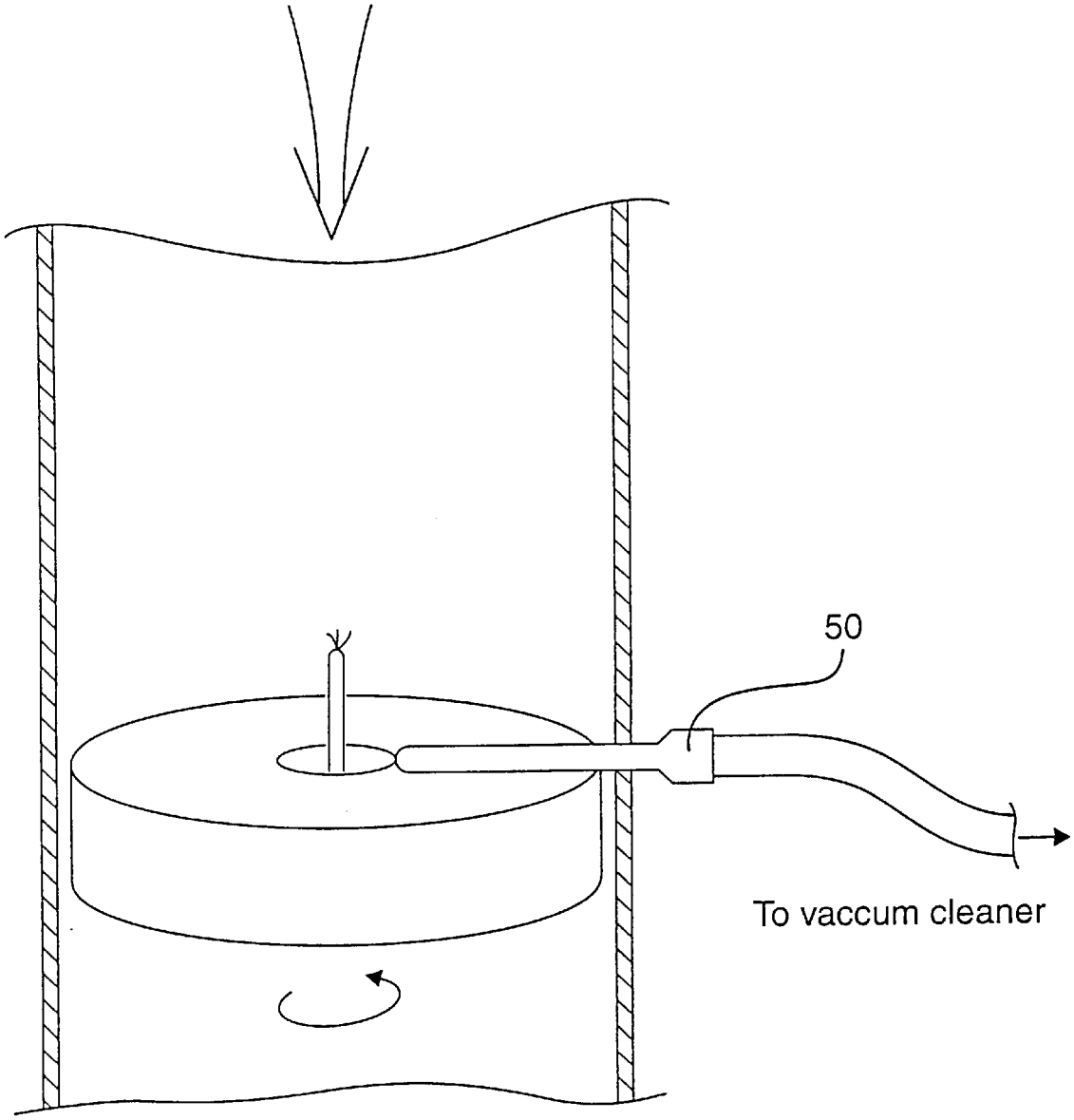
Figure 5A:
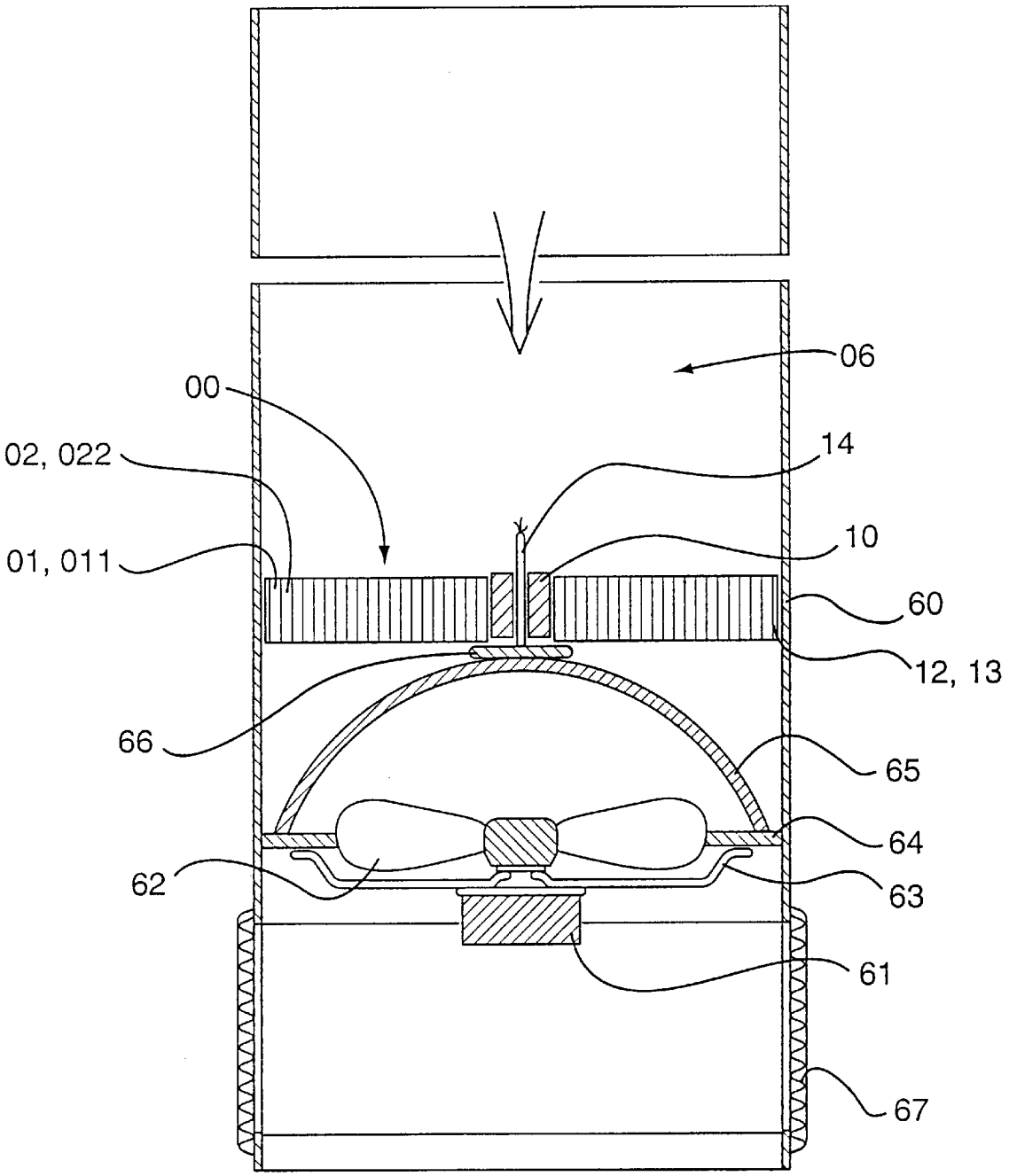
Figure 5B:
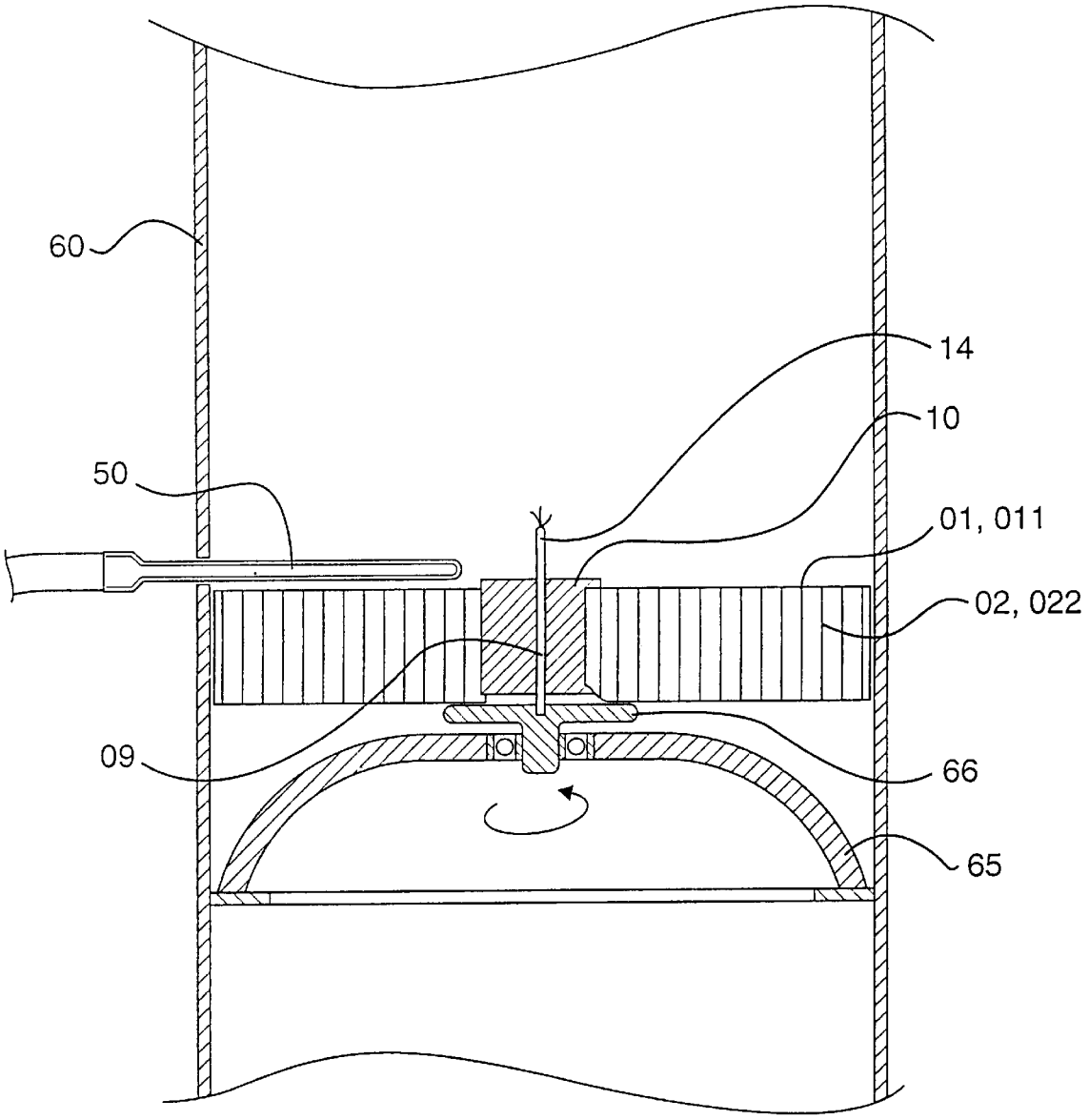
Figure 6:
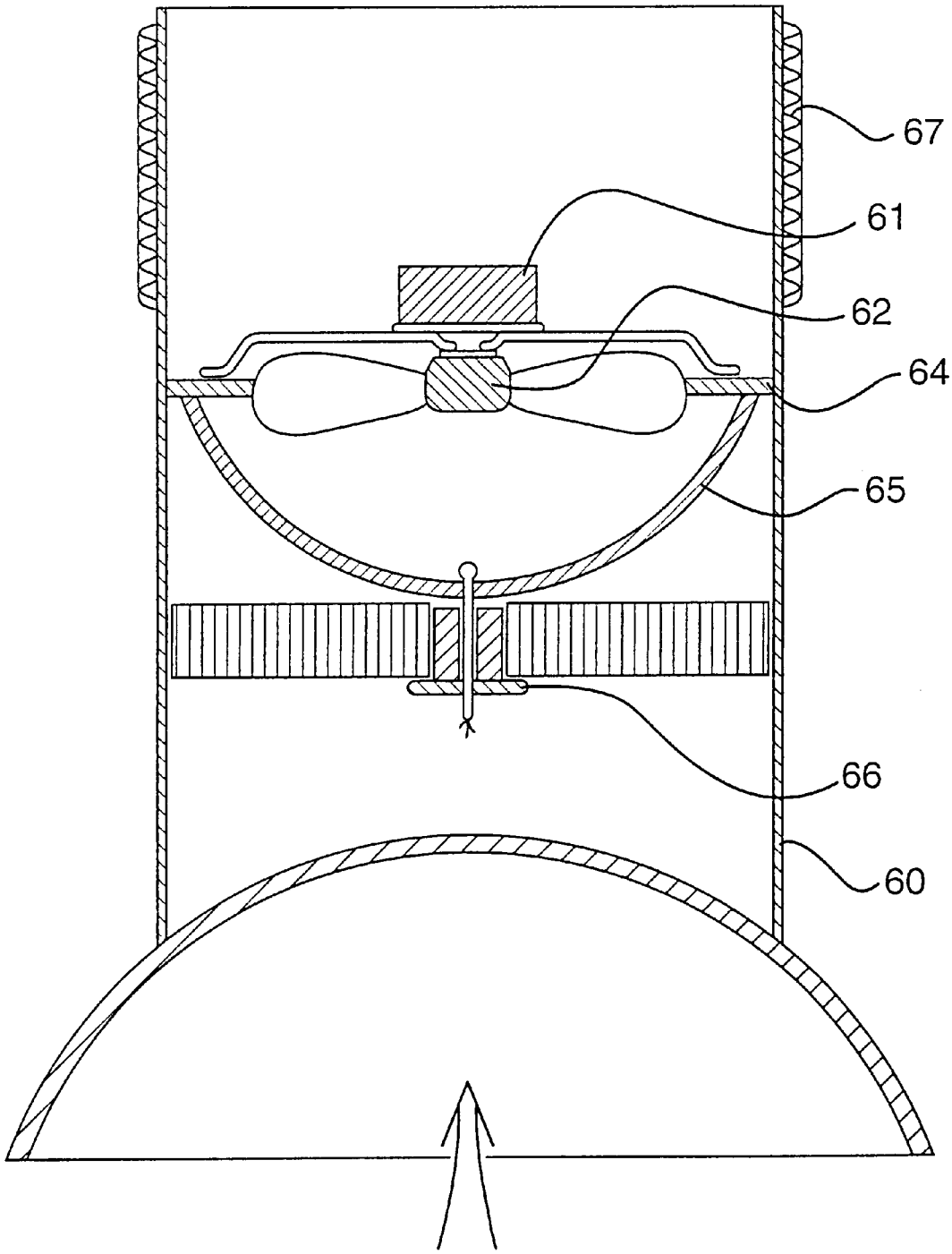
Figure 7:
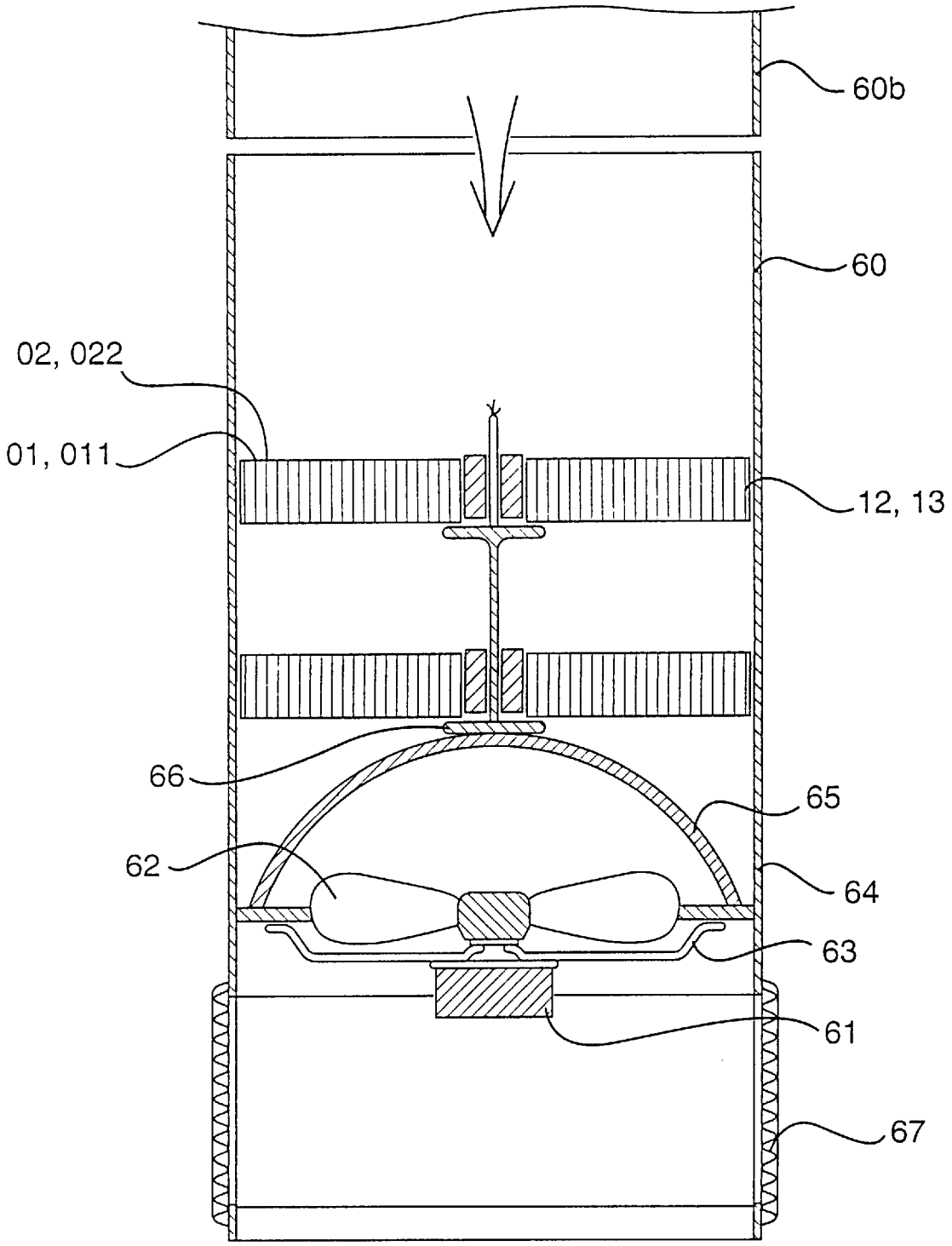

The present invention will be described below, reference being made to the accompanying drawings, where FIG. 1 shows a perspective view of the precipitator (00) according to the present invention; where FIG. 2 schematically shows a bobbin body for constructing the precipitator comprising two groups of electrode elements (011,022); where FIG. 3 schematically shows a perspective view of a construction including two groups of electrode elements (011,022) and a bobbin body (10) suitable for the purpose; where FIG. 4 schematically shows a device for cleaning of the precipitator; where FIG. 5*a* and 5*b* schematically show a section in the air flow direction through the air purifier; where FIG. 6 schematically shows a section in the air flow direction through the cooker hood;

FIG. 7 schematically shows a section in the air flow direction through the air purifier with the arrangement having a dual precipitator.

DETAILED DESCRIPTION OF THE INVENTION

The precipitator (00) according to FIG. 1 includes two electrode elements (01) and (02) in the shape of band-like strips of cellulose-based material, that in the shown example are wound several times around a bobbin body (10).

The radial gap distance "d" between the electrode elements (01,02) is maintained during the winding by means of distancing strips (30), that are applied at one end of the precipitator (00), said distancing strips (30) preferably having an extension in axial direction of the precipitator (00) that is hardly half the axial extension of the precipitator (00). A hot melt adhesive having electrically insulating properties is for instance applied in order to permanently fix the electrode elements (01,02) at a gap distance "d" relative to each other, said hot melt adhesive being preferably applied at the other end of the body (00) of the precipitator, i.e. the opposite end compared to where the distancing strips are applied, and preferably in the shape of strings (05) running radially from the bobbin body and outwards. The number of strings may vary depending on the diameter of the bobbin body and also depending on the material used for the electrode elements. After the fixing/adhesion of the electrode elements (01,02) the distancing strips (30) are removed. This can for instance be effected manually or by means of compressed air that is fed in axial direction of the bobbin body (10). In case compressed air is used the distance strips should be of disposable type since it is too time consuming to re-arrange them for re-use. The distancing strips (30) should be of soft and resilient material to be able to be used in this application.

Of course it is not necessary but practical to effect the winding of the precipitator (00) around a bobbin body (10) and that the fixing of the electrode elements is carried out by means of hot melt adhesive. Nor is it necessary to have the electrode elements (01,02) manufactured from cellulose based material. For certain applications it could be suitable to use other materials of current carrying or semi-conductive material, for instance metallic strips—alumina bands or plastic based materials of electrically conductive, semi-conductive or antistatic material or suitable coatings.

Instead of hot melt adhesive a suitable cast compound, expanding rubber or the like may be used but also more mechanically rigid materials, preferably as reinforcement of hot melt adhesive, cast compound or the like, especially when the gap distance "d" is-relatively large, for instance exceeding 4 mm.

The precipitator according to the present invention can also be designed having two or more groups of electrode elements (011,022). This is especially suitable if relatively large air flow passages are desired, as in air filters for ventilation ducts. FIG. 3 shows schematically a preferred embodiment of the bobbin body (10) when winding two groups of electrode elements.

In many practical applications one can use cellulose-based material, preferably such moisture resistant material for constructing electrode elements or groups of elements, for instance paperboard manufactured by the company Iggesund under the tradename INVERCOTE PB or the like. In exemplifying but not restricting purpose it is stated that the thickness of the material in the electrode elements is in the interval 0.2–1.0 mm. For a material thickness of 0.2 mm the gap distance "d" is preferably about 0.7 mm and for a material thickness of 0.7 mm the gap distance "d" is about 2.5 mm.

The construction of precipitators (00) in accordance with the present patent claims is also especially suitable for effecting electrical screening of the cut edge sections of the electrode elements (01,02,011,022) according to the description of SE patent 9303894-1. Such a processing essentially increases the efficiency of the precipitator and constitutes an efficient moisture barrier. The winding of the electrode elements (01,02) may be effected around a bobbin body (10) having the design disclosed in FIG. 2. The bobbin body preferably consists of two uniform halves of a cylindrical body, displaced relative to each other the desired gap distance "d". The fixing of the electrode elements against the bobbin body (10) may be carried out in a simple way by means of slots (11) as shown in FIGS. 2 or 1. A prerequisite for this is that the bobbin body is constructed from electrically insulating material. Preferably the wound and relative to each other fixed electrode elements (01) and (02) of the precipitator may be located in a casing, preferably in the shape of a cylindrical ring (12) of the same material as the electrode elements. The casing (12) and one of the electrode elements that after winding contacts the casing should preferably be connected electrically to one terminal of the high-voltage source and preferably be earthed. Preferably the casing around the electrode elements (01,02) of the precipitator may constitute the extension of one of the electrode elements that in connection with the winding continues one or several turns after the other electrode element is terminated, the winding continues without distancing structure (30) between the electrode elements and thus a solid structure is created that surrounds the precipitator instead of the casing (12). The same method may be used when designing the precipitator with two or more groups of electrode elements (011,022,0111,0222 etc.).

The electrode elements (01,02) shown in FIG. 1 consist of equal wide bands having edge portions coinciding in the same plane. Of course it is not necessary that this always is the case.

There is nothing that prevents that the electrode elements (01,02) and (011,022) resp. have a different band width and they can also be arranged with a certain displacement relative to each other in the air flow direction.

Within the scope of the invention, in such a case a longer insulating distance is needed between adjacent electrode elements (01,02,011,022) than the distance corresponding to the gap distance "d", one or both of the electrode elements/groups of electrode elements may be designed from, or coated with, two electrically different materials, i.e. two compound bands or bands coated with different materials, one material being an electrically insulating material and the other being a material having a certain conductivity.

To secure electrical connection of the entire band length of the respective electrode elements to respective terminal of the high-voltage source, if some of these or both electrode elements (01,02 or 011,022) are constructed from high-resistant or antistatic material an electrically conductive pattern may be applied along the band length of the electrode elements (01,02 or 011,022). This electrically low-resistant wiring is preferably effected by conductive paint applied to the cut edge of the respective electrode elements or in some other way. It is of course important that this electrically conductive pattern or wiring covers only a fraction of the total band width in order not to risk the desired properties connected to the design of precipitators of high-resistant or antistatic material. When winding the electrode elements it is preferable if the low-resistant electrical cable of one of the electrode elements is located closest to the inlet surface of the precipitator and that the low-resistant wiring of the other electrode element is located closest to the outlet end of the precipitator. Also other ways are possible to electrically connect the electrode elements to the respective terminal of the high-voltage source.

That the precipitator is designed having a fixing structure (05) only on one side of the body of the precipitator makes it possible to coat the electrode elements (01,02) or (011, 022) in the shape of for instance impregnation. For instance lowering into a suitable impregnation substance without affecting the insulating structure. This is interesting in such cases where for instance coating of the electrode elements by carbon filter paste is desired, a coating that is not resilient and thus not applicable before winding of the body (00) of the precipitator.

The design of the precipitator having essentially a circular symmetrical cross-section and fixing of the electrode elements (01,02) or (011,022) preferably on one side of the precipitator is especially suitable in such cases where there is a risk that dust coating between the electrode elements and on top of the insulating structure causes a decrease in the ability of the precipitator to purify the air. Such a design is also suitable if cleaning of the precipitator is arranged by means of vacuum cleaning or both vacuum cleaning and blowing in accordance with the present invention. FIG. 4 shows an embodiment of the device and location of the vacuum cleaner nozzle (50).

Since vacuum cleaning should cover the whole inlet surface of the precipitator (in certain applications both inlet and outlet surface) it is convenient in accordance with this invention to design the vacuum cleaner nozzle (50) on one hand to have its suction gap to radially cover the precipitator and on the other hand to arrange the displacement of the precipitator relative to the vacuum cleaner nozzle by preferably turning the precipitator around its axis.

This solution might of course be used in separate air purifiers but is especially suitable in so called duct filters where the device according to this invention in practice can operate without problems during a long time without service if cleaning of the precipitator as outlined above is effected in short intervals to prevent bridging of dust between the respective electrode elements (01,02) or (011,022). In such applications it is possible also to blow at the precipitator simultaneously with the vacuum cleaning by having a blowing nozzle arranged diametrically opposite to the vacuum cleaner nozzle and on both sides of the precipitator.

FIG. 5*a* shows a section through the air flowing passage of a preferred embodiment of an air purifier comprising a ionization chamber (06) arranged upstream of the precipitator (00) seen in the air flow direction through the device, and a fan (62) arranged downstream of said precipitator. The design of the precipitator makes it is especially suitable to being located in a circular symmetrical casing (60). It is not necessary but preferable to design such a casing out of paper.

In the disclosed example the high-voltage source (61) is arranged in direct connection with the fan (62). The holder of the fan, in the shape of a grate (63), is mounted at an annular element (64) having an outer diameter somewhat less than the diameter of the casing (60) and inner diameter somewhat larger than the diameter of the fan blade. A yoke-shaped element (65) of electrically insulating material constitutes on one hand together with the annular element (66) the surface upon which the precipitator (00) rests and on the other hand a very simple and functional connection of one of the electrode elements (01) or (02) and the connection of the corona electrode to one of the terminals of the high-voltage source (61).

The corona electrode, in the disclosed embodiment in the shape of a carbon fiber brush, is arranged at one end of the holder (14), said corona electrode being located in such a way that its holder (14) extends through a hole (09) arranged in the bobbin body (10) and thus establishes contact with the element (66).

The element (66) may be designed from current carrying, semi-conductive or antistatic material and preferably via an electrical conduit, or in some other way, connected to one terminal of the high-voltage source (61).

The inner jacket of the paper tube (60) above the precipitator (00) constitutes in the shown embodiment also the so called target electrode. Since the conductivity of paper vary with the humidity it is suitable to apply for instance conductive paint on the inner side of the casing (60) and preferably provide electric connection of this side to one of the terminals of the high-voltage unit that can be earthed. Within the scope of the invention it is possible to provide a casing (60) having two separate parts, the upper part (60*b*), also designed from paper, is arranged as an extension of the first part. Due to a relative large distance between the inlet to the device and the outlet from the device, a very efficient utilisation of the air purification of the device is achieved.

FIG. 5*b* shows a modified embodiment of the device according to FIG. 5*a* where the element (66) is provided with an axis that can be rotated relative to the element (65). At the level of the inlet plane of the precipitator and in the casing (60) of the device an opening is so arranged that a suitably designed vacuum cleaner nozzle can be located in said opening. In the shown embodiment the displacement of the precipitator relative to the vacuum cleaner nozzle is effected manually via slot-shaped openings in the casing (60).

To use paper tubes as casing for electrostatic air purifiers provides essential benefits compared to other materials. It has shown inter alia that a certain decrease in the noise level will take place due to the relative softness of the paper compared to other materials of the type sheet metal or plastic. In order to further decrease the noise level it is suitable and very simple to coat the inner surface of the casing (60) by a perforated surface that preferably also is of paper. The air quality of the indoor air is not depending solely on the content of particles in the room. There are also gaseous emissions, for instance from building material, furniture, human beings, domestic animals etc.

Therefore a system for air purification should also include a gas absorbent, for instance in the shape of an active carbon filter. Contrary to electrostatic particle purification a carbon filter provides a very high pressure drop for trough-flowing air and normally requires increased fan speed in order not to risk air transport through air purifiers and consequently a considerable increase in the noise level takes place.

The design of the casing (60) as shown in FIGS. 5*a* and 6 is very suitable for providing the device with a carbon filter of considerable size and hence a considerable ability to absorb gases is achieved. A substantially cylindrical carbon filter (67) is arranged according to FIGS. 5*a* and 6 around the outlet for purified air from the device.

Thanks to the simplicity and the height (length) of the casing the surface of the carbon filter may be essentially larger than the passage surface of the precipitator, said air flow velocity through the carbon filter will become correspondingly less and will not to a degree worth mentioning decrease the air volume at a given fan speed.

Another application area for this invention is purification of cooking fumes. To effectively catch cooking fumes when the cooker hood is located above the cooker at a distance of 50 cm an air flow of almost 600 $m^3$/hour is required. Such a high air flow combining the requirement of a low noise level is hard to achieve in a household appliance that also should fulfil requirements for particle and gas purification of the air transported through the device at a reasonable price and simple service.

The existing appliances do not fulfil the requirements mentioned above, at least not all at the same time.

The present invention allows a simple design of a device for catching and purification of cooking fumes but also for continuous purification of air in a kitchen space.

Traditional cooker hoods are provided with a mechanical filter in the shape of several layers of a metal net structure that to a certain degree purify cooking fumes and prevent the so collected grease to pour or drip back onto the cooker. Such a designed filter part is characterised by a high pressure drop for the air flow and low air flow and high noise level from the fans.

In the embodiment disclosed in FIG. 6 having the precipitator according to the characterising patent claims and with the gas absorbent the requirements of a large air flow at a low noise level and efficient particle and gas purification is fulfilled.

It has shown experimentally that the dust collected upon the electrodes attracts the grease generated during cooking and thus prevents said grease from dripping down upon the cooker. A further improvement is achieved if the electrodes of the precipitator are designed from a convenient cellulose-based material having a certain ability to absorb the grease.

Within the scope of the invention it is also simple to arrange cascade systems of several precipitators following after each other located in the air flow passage through the device. A preferred design of such a cascade is shown in FIG. 7.

The device according to the invention is not associated to a specific way to charge particles and not to the way that the air is transported via an air flow passage. Thus the charging can take place within the ionization chamber or in the space where the device is located. Air transport may be effected by a mechanical fan or by so called ion wind or in another way.

The expression precipitator used in the present application also refers to a supply unit, for instance to an air purifier that is schematically shown in FIG. 5*a*. Although cleaning of the precipitator has been described above it should eventually be exchanged and replaced by a new one.

What is claimed is:

1. A precipitator suitable for use in an air purification apparatus, comprising a body having opposed sides; an air passageway; means for connecting said precipitator to a power source; at least first and second electrode elements having a different potential (01,02), said first and second electrode elements being strips with top and bottom edges, an inner facing side and an outer facing side, and first and second ends; said strips having a coiled configuration about a hypothetical central axis forming windings extending at least one complete revolution about said axis, said first and second electrode elements being spaced apart by a radial gap therebetween wherein said electrode elements having a height essentially less than their coiled length about said hypothetical central axis, said electrode elements being formed from a cellulose based material, and said edge sections of said electrode elements having electrically conductive material thereon and being fixedly secured by strings of adhesive relative to each other on at least one side of said body.

2. A device according to claim 1, wherein said electrode elements comprise at least one group of electrode elements (011,022) having at least one pair of electrode elements.

3. A device according to claim 2, wherein at least one of said electrode elements in at least one of said group of electrode elements has a greater length than the length of the other of said electrode elements, said electrode element having said greater length being positioned furthest away from said hypothetical axis and terminating beyond the end of the other of said electrode elements to thereby form an outer-most ring (13) around said precipitator (00).

4. A device according to claim 1, wherein said strings of adhesive (05) comprise adhesive strings extending radially generally outwardly of said axis and extending in a generally radial direction.

5. A device according to claim 1, including a central body (10) of electrically insulating material, said electrode elements encircling said central body.

6. A device according to claim 5, wherein said apparatus includes an ionization source in operative association with said precipitator, said device including means for supplying power to said ionization source.

7. A device according to claim 6, including an element (66) connected to said power source, wherein said central body (10) includes an aperture (09) therein, and wherein said ionization source is mounted by holding means (14) extending through said aperture of said central body, said power source (61) being connected to said holding means (14) and to at least said element (66).

8. The device according to claim 7, wherein said precipitator has an upstream face and a downstream face, said element (66) being located adjacent the upstream face.

9. The device accord to claim 7, wherein said precipitator has an upstream face and a downstream face, said element (66) being located adjacent the downstream face.

10. The device of claim 7, wherein said element (66) is rotatable about a fixed axis.

11. A device according to claim 1, wherein said precipitator (00) is rotatable about a fixed axis, and further including cleaning means for cleaning said precipitator.

12. A device according to claim 11, including an inlet and outlet surface on said precipitator body, and wherein said means for cleaning said precipitator includes means for providing a suction and a forced air stream for both vacuum cleaning and air cleaning of said inlet and said outlet surfaces of said precipitator.

13. A device according to claim 12, including a plurality of nozzles, wherein said cleaning means for cleaning said precipitator includes said nozzles and having an aperture adapted to substantially enclose said inlet and outlet surfaces as said precipitator rotates about said fixed axis.

14. The device according to claim 1 comprising a plurality of precipitators axially aligned.

15. A method of manufacturing a precipitator (00), comprising the steps of:

providing a source of electrode elements in the form of an elongated strip material of cellulose based material, said electrode elements having longitudinal edges having electrically conductive material thereon;

forming said strip material into a coiled configuration extending about a hypothetical central axis;

simultaneously with said forming step, providing spacing means (30) of a soft resilient material between adjacent windings of said strip material;

securing said strip material with strings of adhesive at at least one end of said precipitator; and removing said spacing means (30).

16. A method according to claim 15, wherein said securing means is a hot melt material, cast compound or an expanding rubber material.

* * * * *